United States Patent [19]

Smith

[11] 4,385,740

[45] May 31, 1983

[54] KITE ARTICLE CARRIER

[76] Inventor: Gary L. Smith, 355 Crooked Creek Dr., Oxford, Mich. 48051

[21] Appl. No.: 251,884

[22] Filed: Apr. 7, 1981

[51] Int. Cl.[3] ..... A63H 27/08; B64C 31/06

[52] U.S. Cl. ..... 244/155 R; 46/86 R

[58] Field of Search ..... 244/155 R; 46/86 R, 46/86 A, 86 B, 86 C

[56] References Cited

U.S. PATENT DOCUMENTS

| | | | |
|---|---|---|---|
| 563,066 | 6/1896 | Rogers | 244/155 R |
| 764,749 | 7/1904 | Moravek | 244/155 R |
| 1,844,594 | 2/1932 | Peterson . | |
| 2,469,449 | 5/1949 | Baskin, Jr. | 244/155 |
| 2,471,199 | 5/1949 | Coyne et al. | 244/155 |
| 2,598,030 | 5/1952 | Bird | 244/155 |
| 2,689,699 | 9/1954 | Sanders, Jr. | 244/155 |
| 2,927,753 | 3/1960 | Feldman | 244/155 |
| 2,936,545 | 5/1960 | Enterkin | 46/86 |
| 3,023,988 | 3/1962 | Christian | 244/155 |
| 3,034,751 | 5/1962 | Droullard | 244/155 |
| 3,044,737 | 7/1962 | Vavra | 244/155 |
| 3,088,701 | 5/1963 | Fricke | 244/155 |
| 3,109,257 | 11/1963 | Curtis | 46/86 |
| 3,209,487 | 10/1965 | Fisher | 46/86 |
| 3,281,099 | 10/1966 | Conway | 244/155 |
| 3,332,645 | 7/1967 | Hansen | 244/155 |
| 3,482,807 | 12/1969 | Morris | 244/155 |
| 3,513,591 | 5/1970 | Hansen | 46/86 |
| 3,596,857 | 8/1971 | Battles | 244/155 |
| 3,612,451 | 10/1971 | Wharton | 244/155 |
| 3,698,671 | 10/1972 | Barry | 244/155 |
| 3,779,491 | 12/1973 | McCoy | 244/155 |
| 3,848,835 | 11/1974 | Browning et al. | 244/155 |
| 3,871,605 | 3/1975 | Kupperman et al. | 244/155 |
| 3,961,764 | 6/1976 | Keough | 244/155 |
| 3,972,496 | 8/1976 | Novorr | 244/155 |
| 3,984,938 | 10/1976 | Cowdrick | 46/86 R |
| 4,042,195 | 8/1977 | Howard | 244/155 |
| 4,123,021 | 10/1978 | Cruise, Jr. | 244/155 |
| 4,129,274 | 12/1978 | Baker | 244/155 |
| 4,141,521 | 2/1979 | Waldvogel | 244/155 |

*Primary Examiner*—Charles E. Frankfort

*Attorney, Agent, or Firm*—Basile, Weintraub & Hanlon

[57] ABSTRACT

An article carrier adapted to be slidably urged upwards along a kite string under the influence of wind and to release the article upon reaching a predetermined position along the kite string. The article carrier includes a frame having a pair of upright arms adapted to be slidably attached to the kite string and to support the frame therefrom. A lever arm is pivotably connected to the frame at one end and a retainer member is connected to the frame intermediate the lever arm and defines a hook adapted to releasably receive the article thereon. An actuating member in the form of a stop is selectively positioned along the kite string and is engaged by the lever arm as the carrier is urged upwards along the string causing the lever arm to pivot and slide the article off of the retainer member freeing it from the article carrier.

11 Claims, 3 Drawing Figures

KITE ARTICLE CARRIER

BACKGROUND OF THE INVENTION

1. Field of the Invention

This invention relates, in general, to kites and, more specifically, to carriers for slidably and releasably carrying articles along the kite string.

2. Description of the Prior Art

Article carriers and, in particular, toy parachute carriers for use with kites are well known. Such devices are used to slidably carry an article, such as a toy parachute, upwardly along the kite string under the influence of wind acting upon the article or parachute. The devices incorporate some type of trip or release mechanism which is used to release the article or parachute from the carrier at an elevation near the kite. The parachute then flows freely down to the ground; while the carrier slides back down the kite string to the user for subsequent re-use.

However, to ensure that the carrier remains on the string while being urged aloft, and to ensure quick and effective release of the article at the desired elevation, the typical prior art kite article carrier has utilized a complex carrier design and release mechanism. This has resulted in a relatively expensive device which has not met wide spread use as a kite accessory.

Further, the release mechanism of the typical prior art article carrier must be reset or manually re-adjusted before the article can be reloaded onto the carrier for subsequent use. This poses a problem since the user is still occupied with flying the kite and does not have free use of both hands to reset the trip mechanism and load the article onto the carrier. In addition, as these types of devices are primarily intended for use by children, easy manipulation of the release mechanism and reloading of the article is essential. However, the manual resetting or re-adjustment of the complex latch mechanism used in prior kite article carriers often is beyond the capability of children. Thus, such devices have not found widespread use.

Thus, it would be desirable to provide an article carrier for use with kites which has a simple, non-complex construction for economical cost. It would also be desirable to provide an article carrier for use with kites which is easy to use. Finally, it would be desirable to provide an article carrier for use with kites which requires no manual resetting or re-adjustment to reload the article onto the carrier.

SUMMARY OF THE INVENTION

The present invention comprises an article carrier for use with a kite which is adapted to be slidably urged upwards along the kite string by wind acting against the article. The article carrier is adapted, upon reaching a predetermined position along the kite string, to release the article therefrom whereupon the article floats freely to the ground and the carrier slides back down along the kite string to the user.

The article carrier of the present invention comprises a frame having a pair of spaced, upright arms adapted to be slidably attached to the kite string and to support the article carrier therefrom. A lever arm is pivotally attached to one end of the frame and includes a pair of spaced legs integrally joined at one end and adapted to ride along the kite string. A retainer member is secured to the frame intermediate the spaced legs of the lever arm. The retainer member is adapted for releasable attachment of the article thereon. Finally, the article carrier of the present invention comprises an actuating means which is adapted to be disposed at a predetermined position along the kite string such that the lever arm engages the actuating means and pivots upwardly to urge the article from the retainer member and causing its release from the article carrier.

In a preferred embodiment, the retainer member has a substantially L-shaped configuration including a first leg which is connected to the frame at one end and disposed at a predetermined angle with respect to the frame. The retainer member also includes a second leg which is perpendicularly connected to the opposed end of the first leg. The retainer member is disposed at a predetermined angle with respect to the frame such that the lever arm, as it pivots upwardly upon engagement with the actuating means, will be perpendicular with respect to the second leg of the retainer member as it engages the article. In this manner, a quick and easy release of the article from the retainer member is achieved.

In a preferred embodiment, the article carrier of the present invention is formed of rod-like members which contribute to a simplified construction having a low, economical cost. Furthermore, the pivotal movement of the lever arm ensures an effective release of the article from the carrier and, at the same time, requires no resetting or re-adjustment before the article can be reloaded onto the carrier for subsequent use. In addition, the article is merely mounted onto the retaining member which again ensures a quick and simple reloading of the article carrier of the present invention.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
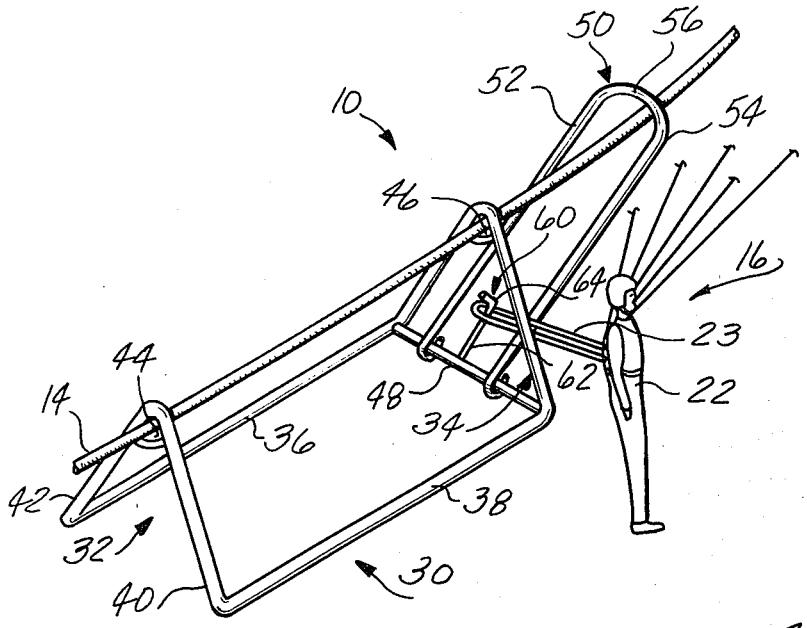
FIG. 1 is a perspective view of the article carrier of the present invention.

Throughout the following description and drawing, identical reference numbers are used to refer to the same component shown in multiple figures of the drawing.

Figure 2:
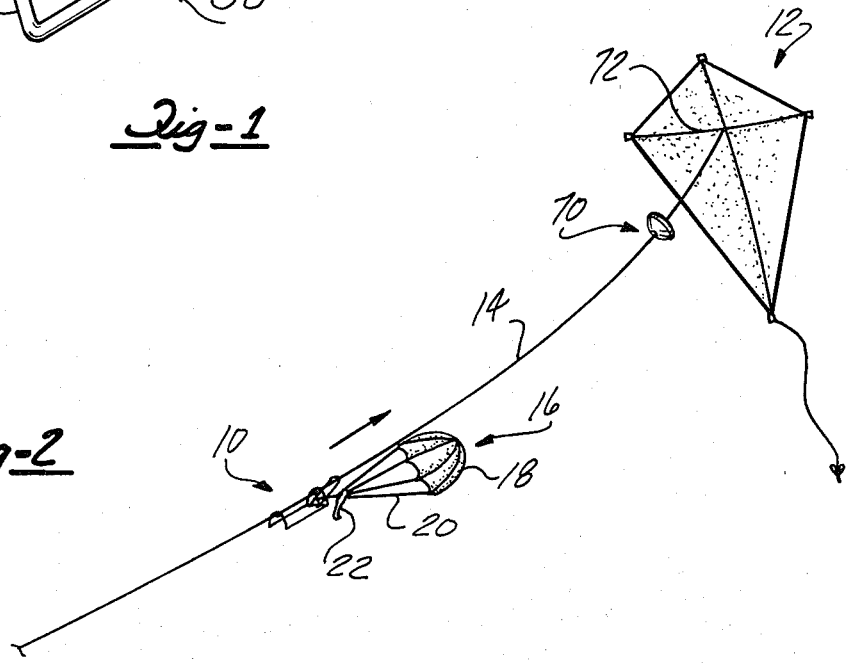
FIG. 2 is a perspective view illustrating the application of the article carrier of the present invention on a kite string.

Referring now to the drawing, and in particular to FIGS. 1 and 2, there is illustrated an article carrier 10 constructed in accordance with the teachings of the present invention. The article carrier 10 is adapted for use with a conventional kite 12 and is adapted to be slidably urged upwards along the kite string 14 under the influence of wind or air currents acting against the article mounted on the carrier. When the carrier 10 reaches a predetermined position along the kite string 14, the article is released from the carrier 10 and floats down to the ground; while the carrier 10 slides backwards along the kite string 14 to the user.

The article carrier 10 of the present invention is adapted to carry any type of article upwards along the kite string 14. Although a toy parachute and simulated figure of a man is illustrated and described as forming the article 16, it will be understood that any other suitable type of article may be used to practice the subject invention.

As described above, the article 16 comprises a toy parachute having a conventionally formed canopy 18 and a plurality of lines 20 which are connected to the ends of the canopy. The lines 20 are gathered together and are connected to a means 22 for weighting the parachute 16. In the preferred embodiment, the weighting means 22 comprises a simulated toy figure of a man. However, it will be understood that any other type of weighting member, such as a simulated aeronautic device, i.e., missile, rocket and the like, may also be used with the parachute 18.

The parachute is acted upon by wind or air currents while it is attached to the article carrier 10 and causes the article carrier 10 to be urged upwards along the string 14. In addition, the parachute 18 causes the article 16 to gently float downward to the ground after it is released from the carrier 10 at a predetermined position along the kite string 14, as described in greater detail hereafter.

As shown in FIG. 1, the article carrier 10 includes a frame 30 having a pair of upright arms 32 and 34 at opposed ends thereof. The arms 32 and 34 are adapted to be slidably attached to the kite string 14 and support the article carrier 10 thereon.

In a preferred embodiment, the frame 30 is formed of a plurality of rod-like members, preferably of a metallic material, which are bent or joined together in the illustrated configuration. Preferably, the frame 30 includes a pair of elongated base members 36 and 38. The upright arms 32 and 34 are connected at opposed ends of the base members 36 and 38. Preferably, each of the arms 32 and 34 is formed with first and second arm portions, such as arm portions 40 and 42 for the arm 32. The arm portions 40 and 42 are joined at one end to the base members 36 and 38 and are integrally joined together at a second end in a substantially V-shaped configuration. Apertures 44 and 46 are formed in the apex of the arm portions 40 and 42 of each of the arms 32 and 34 and are aligned to define a kite string 14 guideway.

The frame 30 also includes a cross member 48 which extends between the base members 36 and 38 at one end of the frame 30. Preferably, the cross member 48 is disposed at the interconnection point of the base members 36 and 38 and the arm portions forming the arm 34.

A lever arm 50 is pivotally connected to the frame 30 at a first or front end thereof. In the preferred embodiment, the lever arm 50 is pivotally connected to the cross member 48. The lever 50 is formed of a rod-like member which is bent into a substantially U or V-shaped configuration having two opposed leg portions 52 and 54. The leg portions 52 and 54 are integrally joined together at junction point 56. The lever arm 50 is pivotally connected to the cross member 48 by bending one end of each leg portion 52 and 54 in a substantially circular configuration around the cross member 48 so as to pivotally secure the lever arm 50 thereon. In use, the lever arm 50 is adapted to ride along the kite string 14 at the junction point 56 between the leg portions 52 and 54 thereof as the article carrier 10 is urged upwards along the kite string 14.

A retainer member 60 is fixedly secured to the frame 30, preferably to the cross member 48 intermediate the opposed legs 52 and 54 of the lever arm 50. Preferably, the retainer member 60 is secured to the cross member 48 at a predetermined acute angle with respect to frame 30, for the reasons described in greater detail hereafter.

The retainer member 60 comprises a rod-like member having a first leg portion 62 which is secured to the cross member 48 at a predetermined angle with respect thereto. The retainer member 60 also includes a second leg portion 64 which is perpendicularly disposed at the opposed end of the first leg portion 62. The retainer member 60 is thusly adapted for releasably attaching the article 16 thereon. Preferably, the article 16 has a loop 23 secured to the weighing means 22 with the loop 23 adapted to be urged over the second leg 64 of the retainer member 60.

Figure 3:
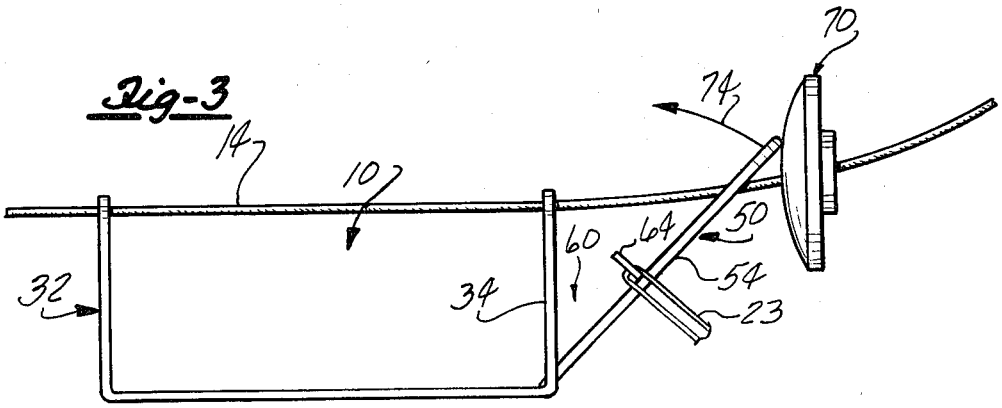
FIG. 3 is a side elevational view depicting the position of the components of the article carrier at the point of release of the article therefrom.

As shown in FIGS. 2 and 3, the article carrier 10 of the present invention further includes actuating means 70 for causing pivotal movement of the lever arm 50 when the article carrier 10 reaches a predetermined position along the kite string 14. In the preferred embodiment, the actuating means 70 is in the form of a stop member which is slidably and selectively positionable along the kite string 14, preferably near the kite 12. Alternately, the actuating means 70 may simply comprise the bow pieces 72 on the kite 12. In either embodiment, the lever arm 50 will be caused to pivot upwards upon engaging the actuating means 70, as illustrated in FIG. 3.

In use, the article 16 is mounted on the article carrier 10 by disposing the loop 23 attached to the article 16 over the second leg portion 64 of the retainer member 60, with the loop 23 also being disposed above the lever arm 50. The article carrier 10 is then released and is urged upwards along the kite string 14 under the influence of wind or air currents acting upon the article 16. In the preferred embodiment, the wind functions to inflate the parachute 18 and propel the parachute 18 and the article carrier 10 upwards along the kite string 14 to a predetermined elevation, preferably adjacent the kite 12.

The article carrier 10 moves upwards along the kite string 14 until the lever arm 50 engages the actuating means, such as stop member 70. This causes upward pivotal movement of the lever arm 50 in the direction of the arrow 70 shown in FIG. 3. The lever arm 50 will continue its upward pivotal movement until the legs 52 and 54 of the lever arm 50 lie in the same plane as the first leg portion 62 of the retainer member 60. At this point, the lever arm 50 is perpendicularly disposed with respect to the upright second leg portion 64 of the retainer member 60. This defines the release point of the article 16 in that continued pivotal movement of the lever arm 50 will cause the lever arm 50 to engage the loop 23 affixed to the article 16 and urge it upwards over the upstanding leg 64 of the retainer member 60 until the loop 23 is free of the retainer member 60 thereby releasing it from the article carrier 10. The article 16 then floats gently down to the ground; while the article carrier 10 slides backwards down along the kite string 14 to the user.

Thus, there has been disclosed a unique article carrier for use with a kite which is adapted to be slidably urged upwards along the kite string to a predetermined position wherein the article is released from the carrier. The article carrier of the present invention is simply formed of rod-like members which results in a low, economical cost. Furthermore, the unique release mechanism incorporated into the article carrier of the present invention requires no re-adjustment or resetting before the article can be reloaded onto the article carrier for subsequent use. In addition, the article is quickly and easily attached to the article carrier thereby resulting in easy manipulation of the device, especially by children.

What is claimed is:

1. An article carrier for use with a kite which is adapted to be slidably urged upwards along a kite string, the article carrier comprising:

a body;

means, mounted on the body, for slidably attaching and supporting the body on the kite string:

a lever arm having a first end pivotally attached to one end of the body, the lever arm adapted to ride along the kite string at a second end;

a retainer member secured to the body adjacent the lever arm, the retainer member adapted for releasable attachment of the article thereon; and actuating means adapted to be disposed at a predetermined position along the kite string such that the lever arm engages the actuating means and pivots upwardly to contact and urge the article from the retainer member causing its release from the article carrier.

2. The article carrier of claim 1 wherein the retainer member is disposed at a predetermined angle with respect to the body and comprises:

first and second integral legs;

the first leg being connected to the body and disposed at a predetermined angle with respect thereto; and the second leg being perpendicularly connected at a second end of the first leg.

3. The article carrier of claim 2 wherein the retainer member is disposed at a predetermined angle with respect to the body such that the lever arm is perpendicularly positioned with respect to the second leg of the retainer member at the point when the lever arm engages the portion of the article attached to the retainer member to release the article from the retainer member.

4. The article carrier of claim 1 wherein the body comprises a frame formed of rod-like members including a pair of spaced base members, the means for attaching the body on the kite string including spaced, upright arms being integrally connected at opposed ends of the base members.

5. The article carrier of claim 4 wherein the arms have aligned apertures formed therein defining a kite string guide way.

6. The article carrier of claim 1 wherein the actuating means comprises the kite.

7. The article carrier of claim 1 wherein the actuating means comprises a stop member adapted to be selectively positioned along the kite string.

8. The article carrier of claim 1 wherein the article comprises a toy parachute including:

a canopy;

lines connected to the edges of the canopy; and means connected to the opposed ends of the lines for weighing the canopy.

9. The article carrier of claim 8 wherein the weighing means includes a loop attached to be disposed over the retainer member to mount the article on the article carrier.

10. The article carrier of claim 1 wherein:

the lever arm includes a pair of spaced legs pivotally attached to the body at one end and integrally joined at a second end, the integral second end of the legs adapted to ride along the kite string; and the retainer member being secured to the body at a point intermediate the spaced legs of the lever arm.

11. An article carrier for use with a kite which is adapted to be slidably urged up the kite string by wind acting against the article, the article carrier comprising:

a frame comprised of rod-like members;

the frame including a pair of spaced base members;

a pair of upright arms disposed at opposed ends of the base members and interconnecting the ends of the base members, the arms having aligned apertures formed therein which are adapted to slidably receive the kite string therethrough and support the article carrier thereon;

a cross member extending between the base members at one end of the frame;

a lever arm having a pair of spaced leg portions pivotally connected to the cross member at one end thereof and integrally joined together at a second end, the lever arm adapted to ride along the kite string at the second end thereof;

a retainer member fixedly secured to the cross member intermediate the spaced legs of the lever arm, the retainer member being formed with first and second leg portions, with the first leg portion being secured to the cross member at a predetermined acute angle with respect thereto and the second leg being perpendicularly connected at the opposed end of the first leg, the retainer member being adapted for releasable attachment of the article thereon; and actuating means adapted to be disposed at a predetermined position along the kite string such that the lever arm engages the actuating means and pivots upwardly urging the article off of the retainer member and causing its release from the article carrier.

* * * * *